United States Patent [19]

Boland

[11] Patent Number: 4,598,724

[45] Date of Patent: Jul. 8, 1986

[54] COIN COUNTER

[75] Inventor: Adam J. Boland, Belmont, Mass.

[73] Assignee: Wellman Company, Inc., Medford, Mass.

[21] Appl. No.: 643,171

[22] Filed: Aug. 22, 1984

[51] Int. Cl.[4] ..... G07D 9/04

[52] U.S. Cl. ..... 133/8 R; 194/334

[58] Field of Search ..... 194/100 A, 102; 133/8 R, 8 C, 3 A, 3 R, 3 E, 3 H

[56] References Cited

U.S. PATENT DOCUMENTS 1,979,659 11/1934 Zierick ..... 133/3 A 4,234,003 11/1980 Ristvedt et al. ..... 133/8 R X

*Primary Examiner*—Stanley H. Tollberg

*Attorney, Agent, or Firm*—Robert T. Dunn

[57] ABSTRACT

The coin counting apparatus wherein coins of various denominations to be counted fall upon a rotating coin table that is designed to catch and hold coins of different denominations at different positions on the table so that each held coin may be detected before it is collected and a count initiated of the value of the coins collected: a denomination code is provided on a code disc driven in rotation in synchronism with the rotation of the table, the code being defined by arc segments of the disc that correspond to the radial positions of coins held on the table; the coins that are caught and held on the table are detected and an initiating signal is produced when a coin so held is detected; at the same time, the corresponding code disc arc segment is detected and signals representative of these are produced; and digital computer circuits responsive to the initiating signal and the code disc signals calculate the value of coins so detected. In a preferred embodiment, the code disc is coded by radiation reflecting and non-reflecting areas that are distinguished by illuminating them and detecting reflected radiation with photodetectors that produce the code disc signals representative of a detected coin denomination.

27 Claims, 8 Drawing Figures

FIG. 5
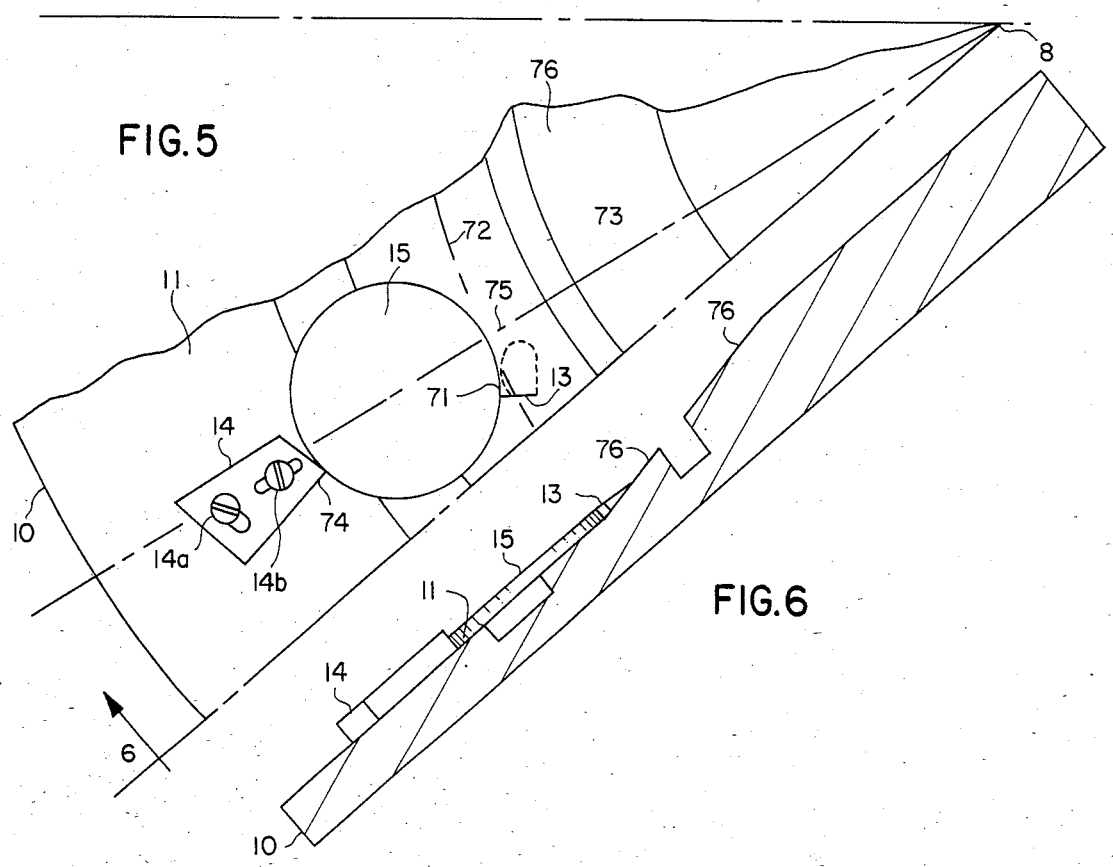
FIG. 6
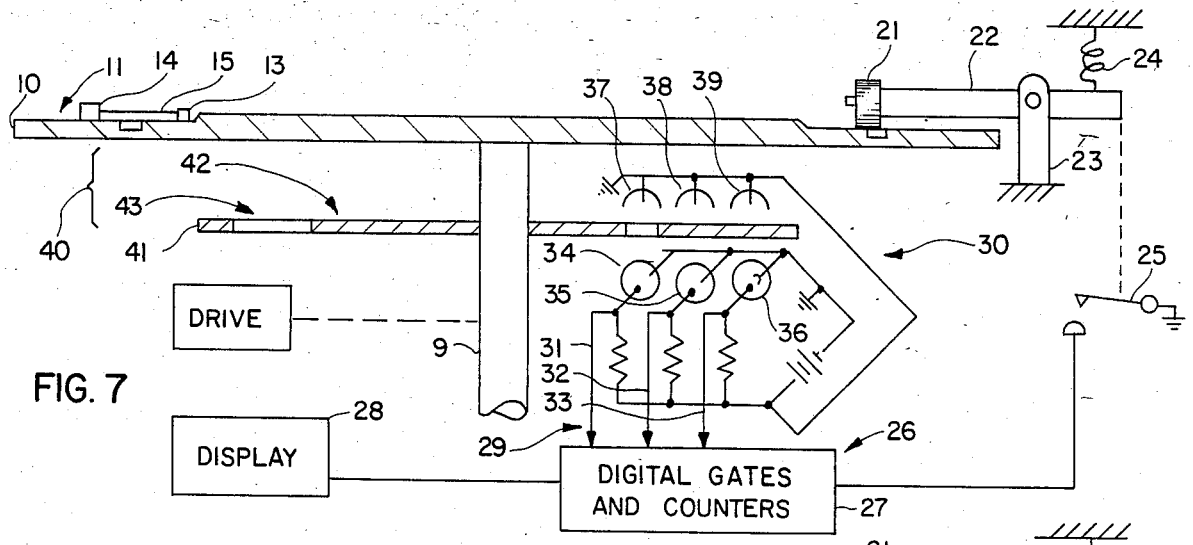
FIG. 7
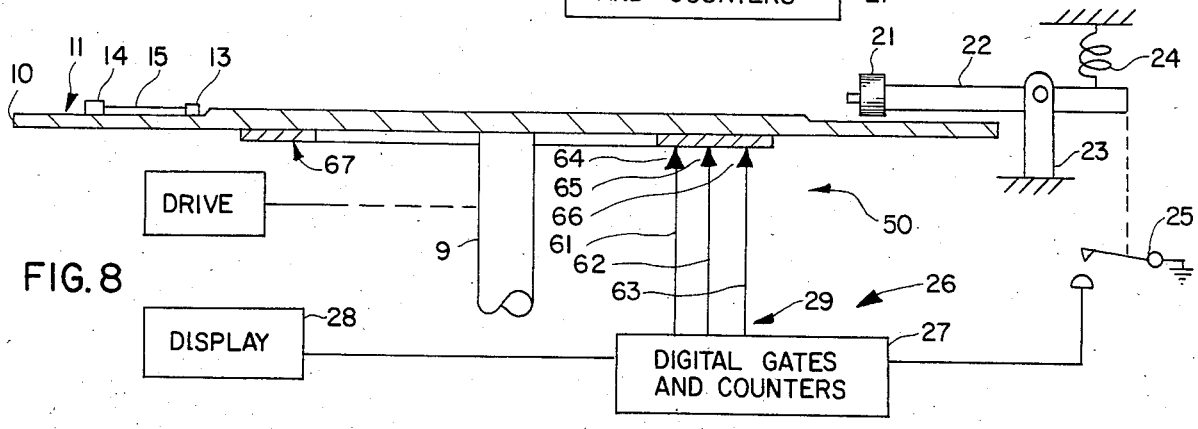
FIG. 8

COIN COUNTER

BACKGROUND OF THE INVENTION

This invention relates to coin counting apparatus, and more particularly to improved apparatus for detecting coins and the denomination of each coin detected from a mix of coins of different denomination dumped into the same opening of the apparatus.

Heretofore, coin counters such as used on buses, subways, toll stations, etc. to receive and count a mix of coins and tokens dumped into a common receiver have consisted of a rotating disc having coin catches at angular (peripheral) positions on the coin table, each designed to intercept and hold one coin of a specific denomination. In operation, a mix of coins are dumped onto the table and when a coin is caught at an appropriate angular position on the table, it is detected and a mechanical counter for that denomination coin is triggered. Then the detected coin is ejected from the rotating table into a collector. Thus, one of the mechanical coin denomination counters advances each time a coin is collected. In such systems, there is a separate mechanical counter for each coin denomination and so when each held coin is detected, the detector must produce a mechanical impulse into only the counter for the denomination of the collected coin.

Clearly, the mechanical complexity of such coin counter machines increases as the number of different denominations of coins increases. For example, where quarters, dimes, nickels, pennies and tokens must be counted, there must be a separate mechanical counter for each of these denominations and the detector that senses a coin caught in position on the table must transmit a mechanical actuation to the appropriate counter. All this is done by a complexity of cranks, levers, gears and pulleys which are subject to frequent repairs due to mechanical wear and malfunction.

A rotating coin table equipped to catch and hold coins at different angular or peripheral positions depending on the coin size is found in prior apparatus. Coin handling, sorting and counting apparatus detect coins of different size (denomination) by diameter and/or thickness. Many of these apparatus have a plurality of coin discharge (output) passages, one for each denomination, around the periphery of the rotating table. Some coin sorters have spaced pockets along the periphery with detents so that each pocket holds a coin of specific diameter. In operation, each detent opens alongside its corresponding discharge passage each time the table rotates and the coin held by the detent is thrown or ejected into the passage. If counting is required, a separate mechanical counter is provided for each denomination (each passage) and it is triggered when a coin enters the passage. The mechanism for opening the detent with each rotation of the table is subject to failure due to mechanical wear and malfunction.

Where coins are held on the rotating table by fixed detents or projections, a mechanism must be provided for detecting and then ejecting the coin so held. Heretofore, where fixed or non-releasing detents have been used, detecting and ejecting mechanisms have been mechanically complicated and so subject to failure, wear and malfunction.

SUMMARY OF THE INVENTION

It is the principal object of the present invention to provide an improved coin counter that accepts a mix of coins of different denomination and detects each coin and its denomination, one coin after another, producing electrical signals representative thereof, before the coin is ejected into a common output passage; and particularly to provide a system in which the mechanical functions are relatively simple, for detecting the coins and counting their value so that the value of a mix of coins dumped into the apparatus can be recorded or displayed.

In all embodiments of the present invention, coin counting apparatus is provided wherein coins of various denominations to be counted fall upon a rotating coin table that is designed to catch and hold coins of different denominations at different positions on the table so that signal initiating means may detect coins so held on the table and initiate a count of the value of the coin so held and detected before it is collected from the table. More particularly, a coin denomination code is provided in a code disc that is driven in rotation on an axis thereof in synchronism with the rotation of the table. The code is defined by arc segments of the code disc that correspond to the angular positions of coins held on the table. In operation, the coins that are caught and held on the table are detected and an initiating signal is produced and, at the same time, the coded arc segment at the corresponding position of the disc is detected and signals representative of that position are produced. Digital computer circuits responsive to the initiating and code disc signals calculate the value of the coin so detected.

In a preferred embodiment, the code disc is coded by radiation reflecting and non-reflecting areas that are distinguished by illuminating them and detecting reflected radiation with photodetectors that produce the code disc signals. Those signals are representative of the position of the coin on the table, and thus, the detected coin denomination.

It is another object herein to provide such a rotating coin table to catch and hold coins at different angular or peripheral positions on the holding surface of the table, depending on coin diameter, using detents or projections (as they are called herein) from the coin holding surface of the table that are fixed in position (not actuated) during the operation of the apparatus.

It is a further object to provide in combination with the fixed coin holding projections, means for detecting each coin held by the projections and then ejecting the coin into a common output passage. These objects are achieved using two projections forming a pair, an inner and an outer projection, for each coin holding position on the table. The inner projections may be identical for all coin positions regardless of the coin diameter and located at the same radius from the table rotation axis. Each outer projection of a pair is located with respect to its corresponding inner projection to hold a coin of given diameter when the coin abuts the pair at points on the coin periphery that are less than $\pi$ and more than $\pi/2$ radians apart, each contacting points being at a face of the projection perpendicular to the holding surface and so parallel to the edge of the coin. The radii from the table rotation axis to these abutting points (contact points) on the coin differ by slightly less than the coin diameter. Other sides of the inner projection slope gradually to the surface of the table and so a coin can be caught only by abutting the one perpendicular face of the inner projection and at the same time abutting the outer projection at the peripheral points of the coin mentioned. Coins of larger diameter will encounter one of the sloping faces of the inner projection and so slide over it.

It is another object herein to provide a relatively simple mechanical mechanism for detecting and ejecting the held coin into a common output passage. This is accomplished by a closed circular channel in the holding surface of the table, centrally located in the holding area, so that all held coins span the channel. At a stationary position in the apparatus, means are provided for detecting each held coin as it passes that position and at another stationary position, immediately after that, a coin guide (or tongue) extends from a common output passage for the coins into the channel. In operation, each held coin is detected and then immediately extracted from the table by the tongue and guided into the common output passage.

These and other objects and features of embodiments incorporating the present invention are described herein in conjunction with the drawings.

DESCRIPTION OF THE DRAWINGS

FIGS. 5 and 6 are enlarged views of a portion of the holding surface of the coin table showing details of the inner and outer pair of coin holding projections and the cross section shape of the table at the inner projection, whereby a coin is held;

FIG. 7 is an electrical-mechanical diagram representing the technique of detecting the coin denomination code to produce signals representing coin denomination using photo-detectors and digital gates and counters responsive thereto for computing and displaying the value of a mix of coins dumped into the apparatus; and FIG. 8 is an electrical-mechanical diagram representing the same technique using arc segments to represent coin denomination that are electrically conducting or non-conducting and electrical contact brushes to produce the signals representing denomination.

DESCRIPTION OF EMBODIMENTS OF THE INVENTION

Denomination Detection

Figure 1:
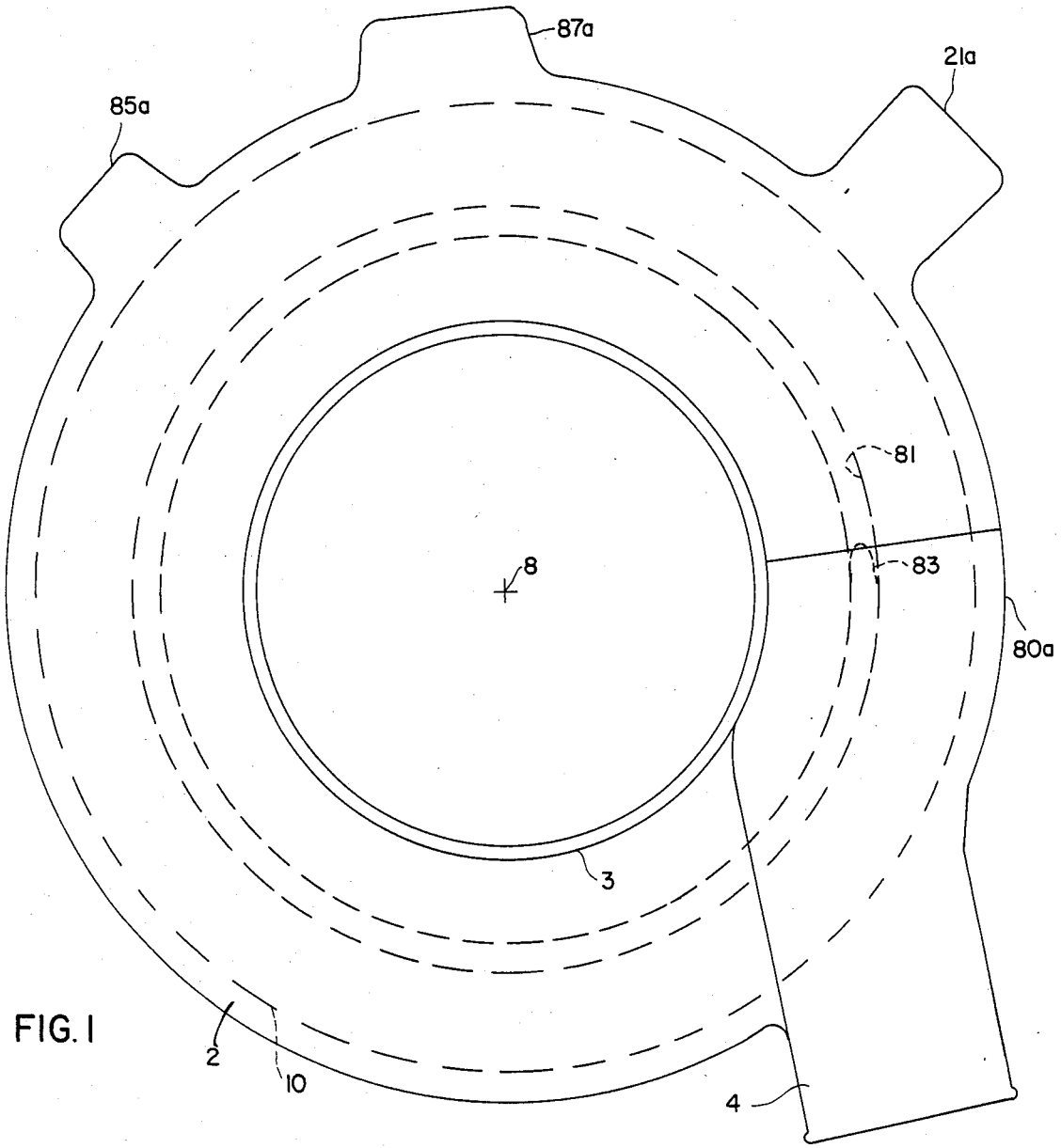
FIGS. 1 and 2 are top and front views of coin counting apparatus incorporating features of the present invention showing the arrangement of the principal parts that detect coins held at angular positions of a rotated coin table in accordance with denomination and eject the coins into a common output passage following detection.
Figure 2:
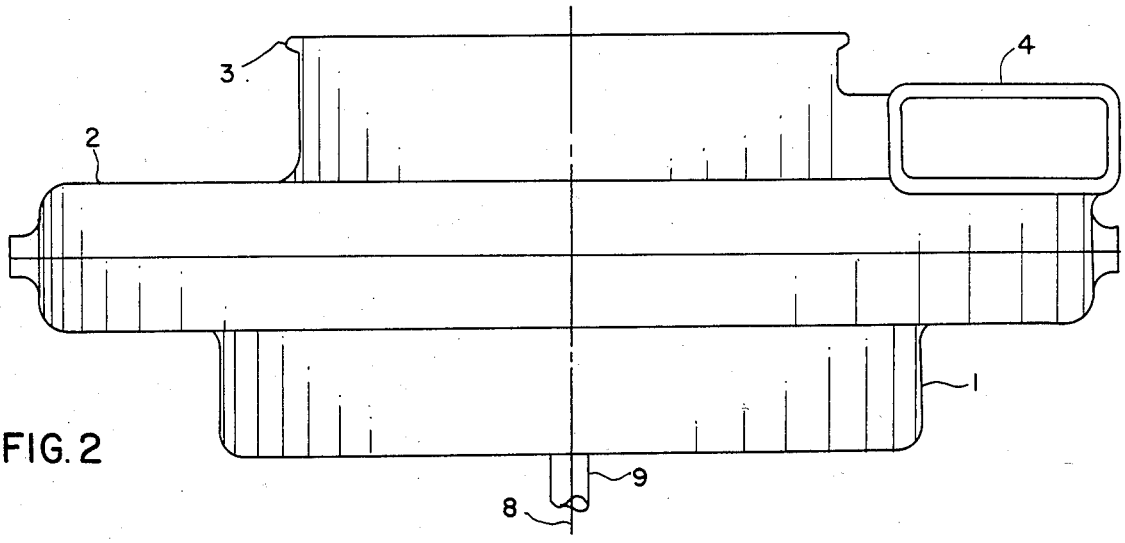
Figure 3:
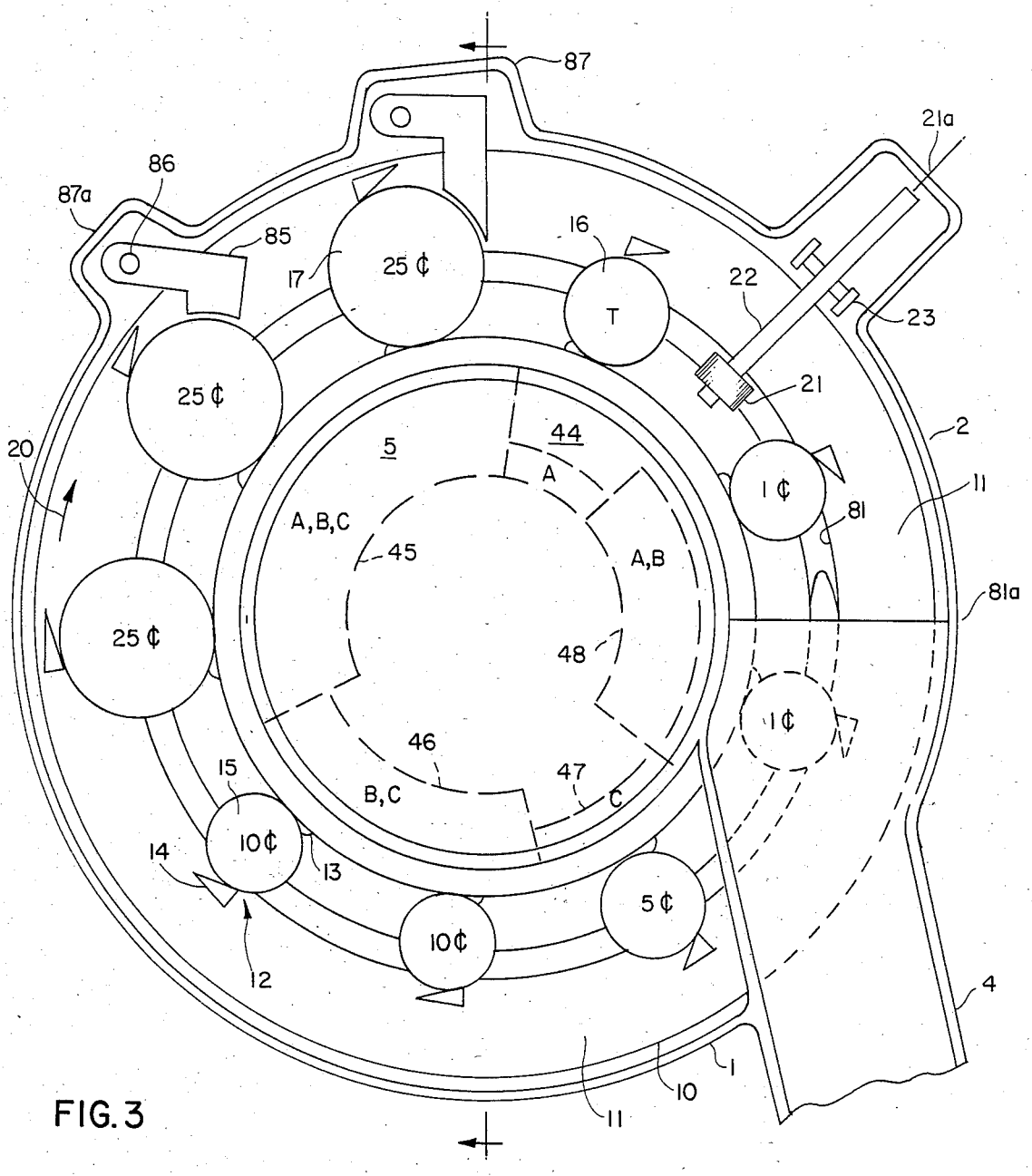
FIG. 3 shows the top view with portions of the top housing removed to show the rotated table, the coin positions, the coin holding projections, the coin detector, the coin ejection structure and common output passages and, in broken line, the coded arc segments representing the coin denomination on a code disc driven in rotation with the table, by which coin denomination signals are produced.

The upper face of the coin table 10 upon which the coins fall is shown in FIG. 3. The outer annular surface 11 of the table provides the coin holding area of the table, where, at specific angular positions, such as position 12, are located two coin holding projections from the coin table, the inner projection and the outer projection, such as 13 and 14 at position 12. These projections at each angular position are spaced and shaped to catch one coin only of a specific denomination. At position 12, the projections 13 and 14 catch and hold a dime 15. If a coin of another denomination impinges against those projections, it will not be caught, and if once a coin is caught and another coin of the same denomination falls against it, the second coin will not be caught.

For example, at angular position 12, the inner and outer projections are so shaped and spaced to catch only a dime when the table is rotating in the direction of the arrow 20. Coins dumped onto the rotating table that are not caught on the coin holding area 11, may be fed by gravity and/or centrifugal force to a return passage (not shown) from which they are returned to be dumped into the apparatus again by a mechanism (not shown). Coins that are caught on the table are counted by the mechanism including a roller 21 that rolls over the face of the coin so caught, pivoting the arm 22 on its pivot 23 and the arm in turn, operating against spring 24, closes the count switch 25 (shown in FIGS. 7 and 8) which initiates an electrical pulse. That initiating pulse from switch 25, along with signals in lines 29 from coin denomination detection system 30, in FIG. 7, or 50 in FIG. 8, are fed to a digital computer circuit 26 including digital gates and counters 27 and a digital display 28 which indicates the total coin count in dollars.

Two embodiments of the coin denomination detection system are shown, As mentioned above, they are 30 in FIG. 7 and 50 in FIG. 8. They both produce electrical signals to the digital computer circuits that indicate the denomination of the coin that is detected and the total dollar value of a bunch of coins dumped into the apparatus. Each of these embodiments and variations of them detect the coin denomination from a coded pattern on or in code disc 41 or code surface 61, rotated with the coin table 10. Different code patterns correspond to different angular positions of coins held on the table and so the particular pattern detected when a coin is detected by roller 21 represents the denomination of that coin.

First Embodiment—Optical Detection

The first embodiment detects the coded denomination patterns optically as shown in FIG. 7, producing signal combinations of signals A, B and C in lines 31, 32 and 33, respectively, that together represent the denomination of the coin that is detected. These signals of a combination are simultaneously fed to the digital gates 27 along with the count signal from count switch 25 and are derived from photo-diodes 34, 35 and 36, each of which is illuminated by a corresponding light emitting diode 37, 39 and 39, respectively. In the optical path between the emitting and detecting diodes is the denomination code pattern 40 on the code disc 41.

The pattern 40 is shown by broken lines in FIG. 3 and consists of pattern segments 44 to 48. The pattern may be on or in a separate code disc, like 41 in FIG. 7, or it may be carried on the bottom of the coin table 10, like 67 in FIG. 8. In either case, the pattern rotates in synchronism with the table. In FIG. 7, the code disc 41 carries the patterns as opaque 42 or transparent 43 areas of the disc.

Referring again to FIGS. 3 and 7, as the table rotates in its rotation direction 20, the first coin the roller 21 encounters is a token (T) 16 and at that position the arc segment 44 on the code disc allows illumination of the photodiode in line 31 only and so the denomination code signal A is the only signal in the three lines 31, 32 and 33. Similarly, when the roller encounters the next coin, quarter 17, all three of the photodiodes are illuminated via segment 45 and so the code for the quarter is A, B and C fed by the three lines to gates 26. At the position of dime 15, segment 46 allows illumination of photodiodes producing only signals B and C in the lines. Similarly, for a nickel, segment 47 produces the signal C only and for a penny segment 48 produces signals A and B only.

Thus, the signals A, B and C in lines 31, 32 and 33 and the output of the switch 25 carry the information to count each coin and the coins denomination and compute the total coin value of a mixed bunch of coins fed to the apparatus. This information is fed into digital gates and counters 26 which sort the information and perform the count to indicate in display 27 the dollar amount that is so counted.

Figure 4:
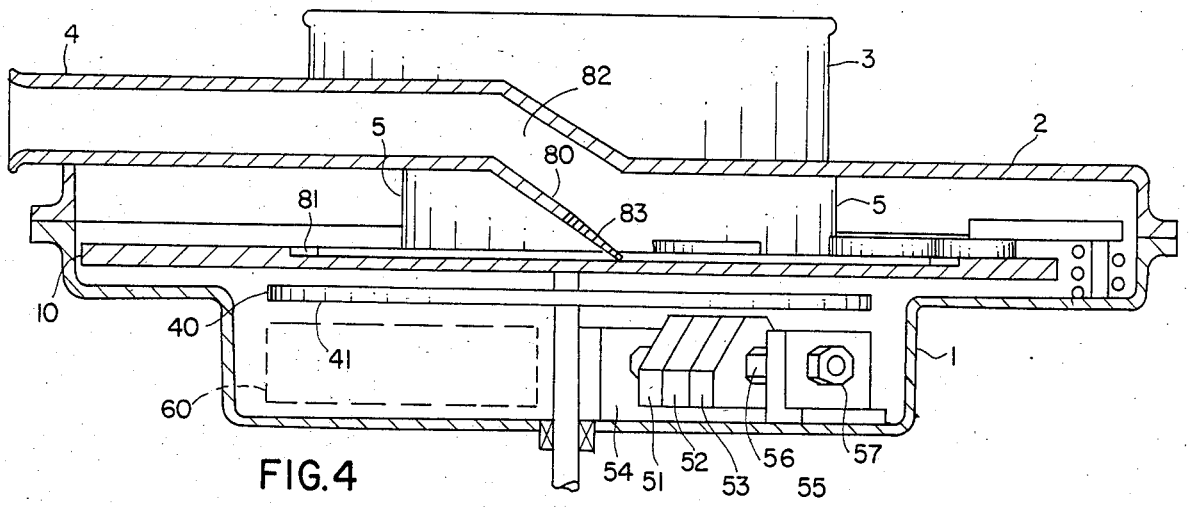
FIG. 4 is a cross section view of the apparatus taken as shown in FIG. 3 showing the ejection structure and infrared light denomination code detectors in the bottom housing that produce signals representing the denomination of each coin detected to the digital computer circuits, also contained therein.

An optical detection system incorporating the features represented schematically in FIG. 7 could be implemented by defining the pattern 40 of segments 44 to 48 of the code disc 41 as radiation reflecting and non-reflecting areas. In that case, an optoelectronic module carrying both the emitter and the detector, side by side, could be used. Such an arrangement of optoelectronic modules is shown in FIG. 4.

Three optoelectronic modules 51, 52 and 53 are assembled on bolt 56, carried on yokes 54 and 55 and fastened thereto by bolt nuts such as 57, with the emitter and detector of each module facing the coded reflecting pattern 44 on the bottom of code disc 40. The yokes may be fastened to the bottom housing 1 of the apparatus. A suitable energizing source, such as battery 58, and biasing resistors 59 and the computer gates and counter shown in FIG. 7, may be contained on a printed circuit board and energizing batteries in an electrical envelope 59, also contained in the bottom housing 1. In this assembly, the bolt 56 is aligned with the roller 21 on top of the rotating coin table, so that the photo-emitters and photo-detectors in the modules align with the code segment that corresponds with the coin detected.

The modules 51 to 53 may each consist of a galium arsenide infrared-emitting diode and a silicon phototransistor mounted in a molded plastic housing and may require more power supply voltages than the simple photo emitter-detector diodes shown in FIG. 7. Such requirements and the provision thereof should be apparent to one skilled in the art without further disclosure herein.

Second Embodiment—Electrical Detection

The second embodiment of the denomination detector detects the pattern electrically as shown in FIG. 8, producing signals A, B and C in lines 61, 62 and 63 that represent the denomination of the coin that is counted. The denomination of that coin is simultaneously fed to the digital gates 27 as a combination of the signals A, B and C in lines 61, 62 and 63 from brushes 64, 65 and 66 that make electrical contact with conductive segments 67 on the bottom side of the coin table 10, as shown. These conductive segments have the same shape, and angular locations as the segments 44 to 48 shown in FIG. 3.

For example, when the roller 22 encounters the token (T) 16, the only electrical contact is through a segment like 44 on the bottom of table 10 by the brush at the end of line 61 and so the denomination code indicated by lines 61, 62 and 63 is A. Similarly, when the roller encounters the next coin, quarter 17, all three of the brushes make electrical contact with the table through a segment like 45 and so the code for a quarter is A, B and C. At the position of dime 15, contact is through a segment like 46 and the code is B and C. Similarly, for a nickel, the code is C and for a penny the code is A and B.

Coin Holding Projections

Each pair of projections on the coin table for holding a coin, as shown in FIG. 3, are similar in structure and arrangement and so only projections 13 and 14 that hold dime 15 at position 12 are described in detail. As mentioned, the inner projections may be identical for all coin positions regardless of the coin diameter and are located at the same radius from the table rotation axis 8. Each outer projection of a pair is located with respect to its corresponding inner projection to hold a coin of given diameter when the coin abuts the pair at points on the coin periphery that are less than $\pi$ and more than $\pi/2$ radians apart, each contacting points being at a face of the projection perpendicular to the coin table holding surface and so is parallel to the edge of the coin. The radii from the table rotation axis to these contacting points on the coin differ by slightly less than the coin diameter. Other sides of the inner projection slope gradually to the surface of the table and so a coin can be caught only by abutting the one perpendicualr face of the inner projection and at the same time abutting the outer projection at the peripheral points of the coin mentioned.

Turning next to FIGS. 5 and 6, two views of the inner projection 13 are shown. The height of 13 from the annular holding surface 11 is about the thickness of the thinnest coin (a dime) and it provides one face 71 at a position with respect to the circle 72 where the upper surface of the table slopes up at 76 from the plane of annular surface 11 toward the center of the table and the intersection of the center line 73 of the intended positions of the dime with circle 72. That intended (proper) position is established by the face 71, circle 72 and the coin diameter. Having established that position, the position of the outer projection 14 may be set. The position of 14 is set by adjusting screws 14*a* and 14*b* so that it contacts the periphery of coin 15 at a point 74 on the periphery of the coin which is less than $\pi$ radians around the periphery from point 71. When that line up is achieved, the arc around the coin periphery from 71 to 74 and from 75 to 74 are both less than $\pi$ radians and more than $\pi/2$ radians. In addition, the radii from the table rotation axis to the contacting points on the coin differ by slightly less than the coin diameter.

Clearly, any other denomination (diameter) coin that does not exactly fit points 71, 74 and 75 will not be held at that position. More particularly the slightly larger penny upon contacting 14 will ride up the slope 76 before encountering the face 71 of 13 or will encounter a tapered face of 13 so will slide over 13 and will not be caught. If the coin is smaller, it will pass between the two projections 13 and 14 and so will not be caught.

Coin Detection And Ejection

Turning next to FIGS. 1 to 4, the station of the housing at which each coin held on the table is detected is at the axis 21*a* of roller 21. The housings 1 and 2 are shaped at this station and other stations described below, to accommodate the mechanisms operating at the stations. Immediately after station 21*a* in the direction of rotation 20, at station 80*a*, the coin detected at station 21*a* is extracted from the table and fed into the coin output passage 4 that is above and even with the coin holding area 11 of the table. For this purpose, a closed circular (continuous) channel 81 is provided centrally located in the surface of the coin holding area of the table, so that all coins properly held on that surface span the channel.

The output passage 4 contained in the upper housing 2 is spaced a sufficient distance above the table so as to at least clear the coin holding projections like 13 and 14 and any coins that may be riding on top of other coins. The entrance to passage 4 at station 80*a* may be even closer to the coin holding surface 11 in order to insure that it catches all coins that are detected at station 21*a* and also must clear the coin holding projections and clear any coins that may be riding on top of the projections or on top of held coins.

In operation, any coin spanning the channel 81 and properly positioned between coin holding projections is lifted from the holding surface and guided by tongue 83 into the entrance 80 of passage 4. The tongue is attached to the bottom edge 80 of the passage entrance and extends into the channel 81.

In order to prevent coins that are not properly held by the coin holding projections, like 13 and 14, on the holding area surface, from reaching the detection station 21*a*, coin clearing mechanisms may be provided. The first of these coin clearing mechanisms, at station 85*a*, includes a hammer 85 held on a spring loaded pivot 86. The hammer 85 rides against the holding area surface and so is impinged against by every properly held coin that passes station 85*a*. Such a coin impinges against the hammer and pushes it aside. The coin is not dislodged by the hammer, but rather is set by the impingement more firmly in position between the holding projections and against the bottom of the table slope at 72. On the other hand, other coins riding on the holding surface, for example, alongside the properly held coin are dislodged upon impacting the hammer and so are not carried to the next station 87*a*.

At station 87*a*, another coin clearing mechanism is provided for clearing coins that may be riding on top of another coin or on top of the holding projections. This mechanism includes an arm 87 held at its spring loaded pivot 88 so that the arm swings out over the holding surface 11, spaced above the surface so that it clears the projections and clears any properly held coins. It impacts any coins riding on top of these so that those coins are not caried on to the detection station 21*a*.

In the preferred embodiment shown in FIGS. 1 to 4, the coin holding area surface 11 of the table as it passes from station 85*a* through station 80*a* is bounded on the inside by a barrier 5 which is a section of cylinder extending from the upper housing, concentric with the rotation axis 8 of the table drive shaft 9 and into concentric circular groove 6 in the table. This barrier and the housings define a passage from station 85*a* to 80*a* which coins can enter only when carried on the surface 11. Coins dumped into the apparatus at the input passage 3 cannot move directly into this passage defined by barriers 5, but are first subject to sorting and distribution onto the holding surface by the rotating action of the table.

By the actions of the clearing mechanisms at stations 85*a* and 87*a*, there is a high degree of certainty that only properly held coins will reach station 21*a*. In order to increase that certainty, the detector mechanism at station 21*a* may be constructed and function so that it will close the switch 25 and so produce the initiation electric pulse, only when the roller 21 rides over the thickness on surface 11 of one coin. This is quite possible, because the thickness of two dimes (the thinnest coin) is more than half the thickness of a nickle (the thickest coin). Also, the interval of the pulse produced could be precisely measured to be sure the detector has not detected two coins abutting each other.

At station 80*a*, where the coin is extracted, the probability that only coins that are properly held will be extracted can be improved. It is improved if channel 81 passes under the center of the extracted coin and the extracting tongue 83 is narrow and in line with the center of the coin. This insures that the coin will ride up the tongue balanced across it.

SUMMARY

The specific embodiments of the invention shown in the figures and the foregoing description are given as a specific examples of embodiments of the invention. It will be understood that various changes and modifications may be suggested by one skilled in the art and such changes and modifications will fall within the scope of the appended claims.

What is claimed is:

1. In coin counting apparatus wherein coins of various denominations to be counted fall upon a rotating table that is designed to catch and hold coins of different denominations at different positions on the table so that signal initiating means may detect coins so held on the table and initiate a count of the coins so held, the improvement comprising, (a) a surface driven in rotation at an axis in synchronism with the rotation of the table, (b) means defining arc segments on said surface that correspond to the radial positions of coins held on the table, and (c) means for detecting coins that are caught and held on the table and producing an initiating signal when a coin so held is detected, (d) means for sensing said arc segments and producing signals representative of the denomination of the coin held at the corresponding position on the table, and (d) means responsive to said representative signals and said intiating signal for calculating the value of coins so detected.

2. Coin counting apparatus as in claim 1 wherein the means for detecting the arc segments on the surface includes:

(a) means for illuminating the surface and light detecting means so arranged that the optical path from said illuminating means to said light detecting means is intercepted by the segments on the surface, (b) whereby, the output of said light detecting means is indicative of the segment and so is indicative of the denomination of the coin.

3. Coin counting apparatus as in claim 2 wherein said arc segments of the surface are distinguished from other parts of said surface by reflecting of the light.

4. Coin counting apparatus as in claim 3 wherein said arc segments reflect the light whereas the other parts of said surface do not reflect the light.

5. Coin counting apparatus as in claim 2 wherein said surface driven in synchronism is on a coded segment disc, said arc segments of said coded disc are distinguished from other parts of said coded disc by transmission of the light, said illuminating means is on one side of said coded disc and said light detecting means is on the other side thereof.

6. Coin counting apparatus as in claim 5 wherein said arc segments of said coded segment disc are transparent to the light.

7. Coin counting apparatus as in claim 2 wherein said means for illuminating is an infrared emitting diode and said light detecting means is an infrared photo-detector.

8. Coin counting apparatus as in claim 3 wherein said means for illuminating is an infrared emitting diode and said light detecting means is an infrared photo-detector.

9. Coin counting apparatus as in claim 8 wherein said infrared emitting diode is a galium arsenide infrared emitting diode and said infrared photo-detector is a silicon photo-transistor and said diode and transistor are held side by side in a source-sensor assembly.

10. Coin counter apparatus as in claim 1 wherein:

(a) each of said arc segments has an inner radius and an outer radius that define the radial boundaries of the segment, and (b) each of said arc segment has a different combination of inner and outer radial boundaries.

11. Coin counting apparatus as in claim 10 wherein all of said arc segment radial boundaries are at one of N different radii and there are up to $(N-1)!$ different arc segments.

12. Coin counting apparatus as in claim 11 wherein:

(a) there are $N-1$ different sensing means, each located at a different radial distance from said axis and (b) the magnitude of said radius of location of each sensing means being between the magnitude of two boundary radii that are adjacent in magnitude, (b) whereby the different sensing means may be designated $(1-(N-1))$ and each different arc segment may be represented by signals from different combinations of detectors total $(1-(N-1))$ at a time.

13. Coin counting apparatus as in claim 1 wherein the means for calculating the value of coins detected includes:

(a) binary gate circuits, and (b) means feeding said representative signals and said initiating signals to the inputs of the gate circuits, and (c) means including binary counter circuits for combining the outputs of said gate circuits and producing a count number that is representative of the total monetary value of the coins detected.

14. Coin counting apparatus as in claim 1 wherein said means for sensing said arc segments on the surface includes electrical contacts that ride against the segmented parts of the surface making electrical contact therewith whereby the combination of signals from said brushes are indicative of the denomination of the coin.

15. In coin handling, sorting or counting apparatus wherein coins of various denominations to be handled sorted or counted fall upon a rotating coin table that is designed to catch and hold coins of different denominations at different positions on the table for further processing by the apparatus, the improvement comprising (a) an annular area of the table designated for catching and holding the coins, with each held coin at a time at a different angular position on the annular area (b) an inner projection at each coin angular position at the inner radius of the annular area (c) an outer projection at each coin angular position at the outer radius of the annular area (d) the inner and outer projections for a held coin being located at different radii, the difference being slightly less than the diameter of the held coin, (e) so that the edge of said held coin contacts each projection and the points of said contact are at angular positions on the periphery of the said held coin that are less than $\pi$ radians and more than $\pi/2$ radians apart.

16. Coin apparatus as in claim 15 wherein all of said inner projections for held coins at different angular positions are the same and located at the same radius.

17. Coin apparatus as in claim 16 wherein at least some of said outer projections are adjustable so that the point of contact of the edge of the coin held thereby is adjustable.

18. Coin apparatus as in claim 15 wherein:

(a) each of said inner projections includes a face that is perpendicular to said annular area of the table so that said face is parallel to the periphery of the coin held thereby at the point of contact therewith and (b) other sides of said inner projection taper to the surface of said annular area of the table, (c) whereby a coin sliding along said annular area that does not first meet said inner projection at said perpendicular face thereof will slide over said inner projection and so will not be held thereby.

19. Coin counting apparatus as in claim 18 wherein the location of said outer projection with regard to the perpendicular face of said inner projection at a coin angular position is such that only those coins of a predetermined diameter will be held thereby.

20. Coin counting apparatus as in claim 19 wherein the the spacing of said outer projection with respect to the perpendicular face of said inner projection at a coin angular position is such that coins of diameter smaller than the coin held thereby will slide between said inner and outer projections.

21. In coin counting apparatus wherein coins of several denominations to be counted fall upon a rotating coin table disc that is designed to catch and hold coins of different denominations on an annular area of the table at different angular positions on the table for counting by the apparatus, means for removing such coins that are properly held one by one, the improvement comprising, (a) a closed channel in the surface of said annular area of the table located so that all coins held on said surface lay over said channel (b) means defining an output passage for coins beginning at a point at the same radial position as the channel displaced axially above said annular surface and (c) means extending from the beginning of said output passages downwardly across the path moved by the held coins when said disc rotates and into said channel, (d) whereby coins held on said surface of the annular area are guided from said surface by said extending means into said output passage.

22. Coin counting apparatus as in claim 21 and further including, (a) means for detecting coins held on said annular surface at an angular position reached by a held coin due to rotation of said disc just before said coin reaches said extending means.

23. Coin counting apparatus as in claim 21 and further including, (a) means for intercepting a coin that rests on top of a held coin on said annular surface and removing said coin on top so that is not guided by said extending means into said output channel and (b) said intercepting means is located just before said held coin reaches said extending means.

24. Coin counting apparatus as in claim 21 and further including, (a) means for dislodging a coin that rests on said annular surface and abuts a held coin so that said abutting coin is removed from said annular surface and (b) said dislodging means is located just before said held coin reaches said extending means.

25. Coin counting apparatus as in claims 22 or 23 or 24 wherein, (a) said means for detecting, intercepting and dislodging coins are located so that a given held coin reaches them in the order dislodging, intercepting and detecting.

26. In coin handling, sorting or counting apparatus wherein coins of various denominations to be handled sorted or counted fall upon a rotating coin table, means for catching and holding coins of different denominations at different positions on the table and means for removing such coins that are properly held one by one, the improvement comprising, (a) an annular area of said table designated for catching and holding the coins, with each held coin at a different angular position on said annular area, (b) an inner projection at each coin angular position at the inner radius of said annular area, (c) an outer projection at each coin angular position at the outer radius of said annular area, (d) the inner and outer projections for a held coin being located at different radii, the difference being slightly less than the diameter of the held coin, (e) a closed channel in the surface of said annular area of the table located so that all coins held on said surface lay over said channel (f) means defining an output passage for coins beginning at a point at the same radial position as said channel displaced axially above said annular area surface and (g) means extending downward from the beginning of said output passage across the path moved by the held coins when said disc rotates and into said channel, (h) whereby any coins held on said annular area surface are guided from said surface by said extending means into said output passage.

27. In coin counting apparatus wherein coins of various denominations to be counted fall upon a rotating table that is designed to catch and hold coins of different denominations at different positions on the table so that signal initiating means may detect coins so held on the table and initiate a count of the coins so held, the improvement comprising, (a) an annular area of said table designated for catching and holding the coins, with each held coin at a different angular position on said annular area, (b) an inner projection at each coin angular position at the inner radius of said annular area, (c) an outer projection at each coin angular position at the outer radius of said annular area, (d) the inner and outer projections for a held coin being located at different radii, the difference being slightly less than the diameter of the held coin, (e) a surface driven in rotation at an axis in synchronism with the rotation of the table, (f) means defining arc segments on said surface that correspond to the radial positions of coins held on the table, and (g) means for detecting coins that are caught and held on said table and producing an initiating signal when a coin so held is detected, (h) means for sensing said arc segments and producing signals representative of the denomination of the coin held at the corresponding position on said table, and (d) means responsive to said representative signals and said initiating signal for calculating the value of coins so detected.

* * * * *